United States Patent [19]

Nakanishi

[11] Patent Number: 4,845,457

[45] Date of Patent: Jul. 4, 1989

[54] DEFORMABLE TYPE VARIABLE RESISTOR ELEMENT

[75] Inventor: Motoyasu Nakanishi, Fujishi, Japan

[73] Assignee: Kabushiki Kaisha Cubic Engineering, Shimizu, Japan

[21] Appl. No.: 125,352

[22] Filed: Nov. 25, 1987

[51] Int. Cl.[4] ..... H01C 10/10

[52] U.S. Cl. ..... 338/114; 338/47

[58] Field of Search ..... 338/99, 112, 114, 115, 338/47

[56] References Cited

U.S. PATENT DOCUMENTS 4,571,542 2/1986 Arai ..... 338/99 X 4,729,809 3/1988 Dery et al. ..... 338/114 X

FOREIGN PATENT DOCUMENTS 2744800 4/1978 Fed. Rep. of Germany ..... 338/99

2854080 6/1979 Fed. Rep. of Germany ..... 338/99

*Primary Examiner*—E. A. Goldberg

*Assistant Examiner*—M. M. Lateef

*Attorney, Agent, or Firm*—Wenderoth, Lind & Ponack

[57] ABSTRACT

A deformable type variable resistor element using silicone gel with a penetration value of approximately 50 to 200 as a basic member in which electrically conductive fine particles as much as 20 to 50 weight percent are mixed, which basic member is provided with at least a pair of electrodes so that the conductive fine particles contained in the basic member come in contact each other to form a number of electrical passages between the pair of electrodes when the basic member is physically deformed by an external force.

16 Claims, 7 Drawing Sheets

DEFORMABLE TYPE VARIABLE RESISTOR ELEMENT

BACKGROUND OF THE INVENTION

The present invention relates to the deformable type variable resistor element in which, when it is deformed by an external force, a number of electrical passages are formed and the current value flowing between the electrodes varies.

As this type of deformable type variable resistor element, the element employing a pressure conductive rubber material has been well known. This conductive rubber material is adapted to form a number of electrical passages by deforming the basic member made of elastic rubber material to make conductive fine particles mixed in advance in said basic member contact each other while it is adapted to discontinue the electrical passages formed by physical deformation of the basic member by separating internal conductive fine particles one from another.

Such conductive rubber material is accompanied by certain problems such that an electric conducting action, due to deformation of the basic member, that is, a resistance varying action cannot be obtained unless a force larger than the natural elastic force of rubber member which is the material for the basic member is applied to the basic member. In addition, it also accompanies a problem that the deformability is reduced and it is difficult to actuate said conductive rubber material with an extremely small external force since the repulsive elasticity of the basic member concentratively acts on a portion to which a force is applied.

The conventional pressure conductive rubber material has problems in that it produces a repulsive force against an external force because of the elasticity of said basic member and this repulsive force becomes proportionally large compared with the external force; this poses difficulties in the use of such conventional rubber materials when the external force is an impact force and the conductive rubber material is required to provide a shock absorbing effect.

SUMMARY OF THE INVENTION

An object of the present invention is to provide a deformable type variable resistor element capable of providing a resistance varying operation in response to an external force applied even though said external force is small.

This object can be achieved by using a silicone gel made of gelled silicone resin with a penetration value of approximately 50 to 200 as the basic member and mixing conductive fine particles in said basic, member.

Since such silicone gel has the characteristics that it disperses an external shock like a liquid and has other characteristics in that its repulsive elasticity is substantially negligible as an operation of the basic member of the deformable type variable resistor element as compared with a conventional elastic rubber material, the silicone gel allows positive deformation of a portion of the basic member, where the external force is applied even though the force is small and thus permits electrical conduction therethrough.

Another object of the present invention is to provide a buffer-acting deformable type variable resistor element capable of absorbing an external shock.

This object can be achieved by controlling the penetration value of the silicone gel, the thickness of the basic member and the quantity of the conductive fine particles mixed in the basic member.

In other words, the silicone gel provides an extremely small repulsive elasticity and dispersedly absorbs the external force by a non-elastic deformation as a substantial action. Thus, the basic member as a whole can absorb an external force without causing a repulsive elasticity, even though said external force is a large shock type force.

Another further object of the present invention is to provide a magnetically sensitive deformable type variable resistor element.

This object can be achieved by using magnetic material such as, for example, nickel particles as said conductive fine particles.

PREFERRED EMBODIMENT OF THE INVENTION

Figure 1:
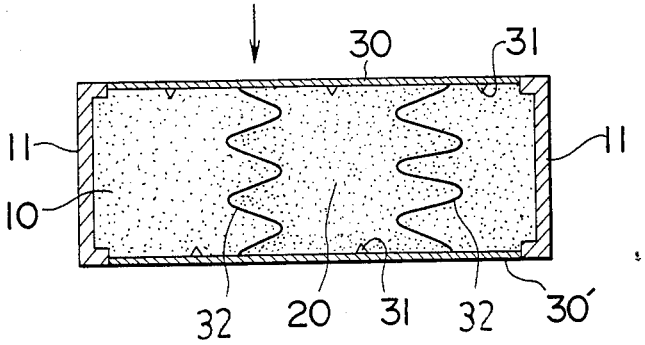
FIG. 1 is a vertical sectional view of the deformable type variable resistor element in accordance with the present invention.

FIG. 1 is a vertical sectional view of the deformable type variable resistor element in accordance with the present invention, showing the basic member 10 in which a lot of conductive fine particles 20 are mixed.

Said basic member 10 is made of the silicone gel having the penetration value of 50 to 200 which is measured in accordance with JIS (Japanese Industrial Standard) K 2530-1976 (50 g load) and this silicone gel is made up by mixing silicone resins such as, for example, the tradenames Toray Silicone CF-5027A and CF-5027B manufactured by Toray Silicone Kabushiki Kaisha in Japan. These Toray Silicones CF-5027A and CF-5027B are volume production items of Toray Silicone CY52 which is a two-liquid mixed type silicone gel developed by Toray Silicone Kabushiki Kaisha, and the silicone gel using Toray Silicone CY52 is disclosed by the U.S. patent application Ser. No. 87970 filed on Aug. 17, 1987.

The external surface of said basic member 10, except electrodes 30 and 30', is covered with a soft non-tacking external layer 11, and this external layer 11 can be formed by applying a silicone resin type coating agent to the external surface of the basic member 10 and bridging it or applying an unwoven cloth or soft external film with a small repulsive elasticity to the basic member 1.

An acetic acid type or oxime type mold parting agent or bonding agent employing silicone resin as the base can be used as coating material for the former. This parting or bonding agent includes the SH237 Dispersion, SE5001 and SH780 (product names) manufactured by Toray Silicone Kabushiki Kaisha.

The external coating film for the latter includes TUFTANE (trademark) manufactured by Lord Chemical Products, Inc. and ZDEL (trademark) which is a high damping rubber manufactured by Kabushiki Kaisha Bridgestone.

A desired conductive material can be used as said conductive fine particles 20. For example, a magnetically sensitive type variable resistor element can be made by using magnetically conductive material such as nickel and the specific gravity of the variable resistor element can be selected by selecting the mass of conductive substance.

Said electrodes 30 and 30' can be made by applying a conductive agent to the basic member 10 or by adhering an aluminum foil or the like to the basic member. Otherwise the protrusions 31 can be provided to be protruded from electrodes 30 and 30' as shown in FIG. 1 and can be buried inside the basic member.

Heretofore, the variable resistor element in accordance with the present invention can be configured as described below.

In addition to the conductive fine particles 20, insulating magnetic fine particles or organic or inorganic hollow fine particles which are so-called "balloons" and thus the magnetic characteristic and other physical properties of the variable resistor element in accordance with the present invention can be added.

The silicone gel material in which said balloons are mixed is disclosed by U.S. patent application Ser. No. 87970 filed on Aug. 17, 1987.

Flexible conductors 32 with a high resistance value can be internally passed through said basic member 10 a shown in FIG. 1 so that the bias current is supplied between electrodes 30 and 30' at all times. Accordingly, the external circuit element connected to the electrodes 30 and 30' can be actuated by a bias current.

Though said electrodes 30 and 30' are generally provided in opposing directions, they can be disposed in non-opposing directions such as, for example, an orthogonally intersecting direction and need not be limited to the embodiment.

In addition, said electrodes 30 and 30' can be opposingly buried through a part of said basic member 10. Since the variable resistor element in accordance with the present invention is made as described above, any physical deformation which takes place in the basic member 10 due to an external force, such as a pushing force applied to the basic member 10, causes the conductive fine particles 20 mixed in said basic member 10 to come in contact each other to form a complex circuit network whereby the electric resistance between electrodes 30 and 30' and the value of the current flowing between the electrodes varies.

If the current flowing between electrodes 30 and 30' is small and substantially zero in the load circuit when the basic member 10 is not deformed, the current can be supplied to the load due to deformation of the basic member 10 and, in this case, the variable resistor element of the present invention will operate as the deformable type switching element.

Said internal circuit network is formed with a number of parallel circuits which are formed in general due to the increase of mutual contact of conductive fine particles 20 if an external force is applied in the arrow direction in FIG. 1.

The variable resistor element in accordance with the present invention employs a silicone gel with penetration value of 50 to 200 as the material for the basic member. Accordingly, the conductive fine particles 20 having a stable conductivity to the silicone gel should be used. In other words, the conductive fine particle 20 should be made of a material which is not oxidized on the surface thereof, when it is mixed in the silicone gel. In this embodiment, fine particles of nickel, cobalt, gold, silver, carbon, etc. or those which coated with those conductive substances should be used.

If said fine particles are mixed in the basic member, the apparent hardness of the basic member becomes high and the penetration value of silicone gel is selected in accordance with the type and quantity of fine particles.

Said fine particles are prefered to be uniformly dispersed in the basic member of silicone gel and, in particular, it is necessary to exercise care to prevent sedimentation of fine particles in the basic member.

The silicone gel which forms the basic member of the variable resistor element according to the present invention generally has a specific gravity of approximately 0.98 and it takes about 30 minutes to gel a liquid type silicone. Therefore, the conductive fine particles will be concentrated at the upper part after gelling if they are lighter than the silicone gel and at the bottom part after gelling if they are heavier than the silicone gel. To prevent such uneven distribution of fine particles and ensure even distribution of fine particles in the basic member, the specific gravity of the fine particles should be as near that of the silicone gel as possible.

For this purpose, in the embodiment, fine particles with a specific gravity of 0.90 which are made up by coating glass-based silica balloons with nickel are used as the conductive fine particles 20. These fine particles having the particle size of approximately 30 to 100$\mu$ of 20 to 50 weight per cent are mixed in the basic member made of silicone gel.

The preferable percentage for mixing is approximately 25 to 40%. In case of less than 25%, there is a problem that the volume resistance will increase and in case of more than 40, the apparent hardness of the basic member 10 will be high to effect the buffering effect.

The NCP (product name) manufactured by Nippon Kogaku Kogyo Kabushiki Kaisha in Japan is available as the conductive fine particles described above.

The variable resistor element in accordance with the present invention can be prepared by mixing the aforementioned CF-5027A (product name) and the CF-5027B (product name) manufactured by Toray Siicone Kabushiki Kaisha, further mixing conductive fine particles in it, molding the mixture after removing bubbles as required and finally gelling the molded mixed material.

In this manufacturing process, the molding process can adopt such various methods as injection molding, roll coating, silk screen printing, spraying and molding and the gelling process can be carried out by heating at 80° to 150° C. for 30 to 240 minutes.

The variable resistor element in accordance with the present invention has the following characteristics.

Figure 2A:
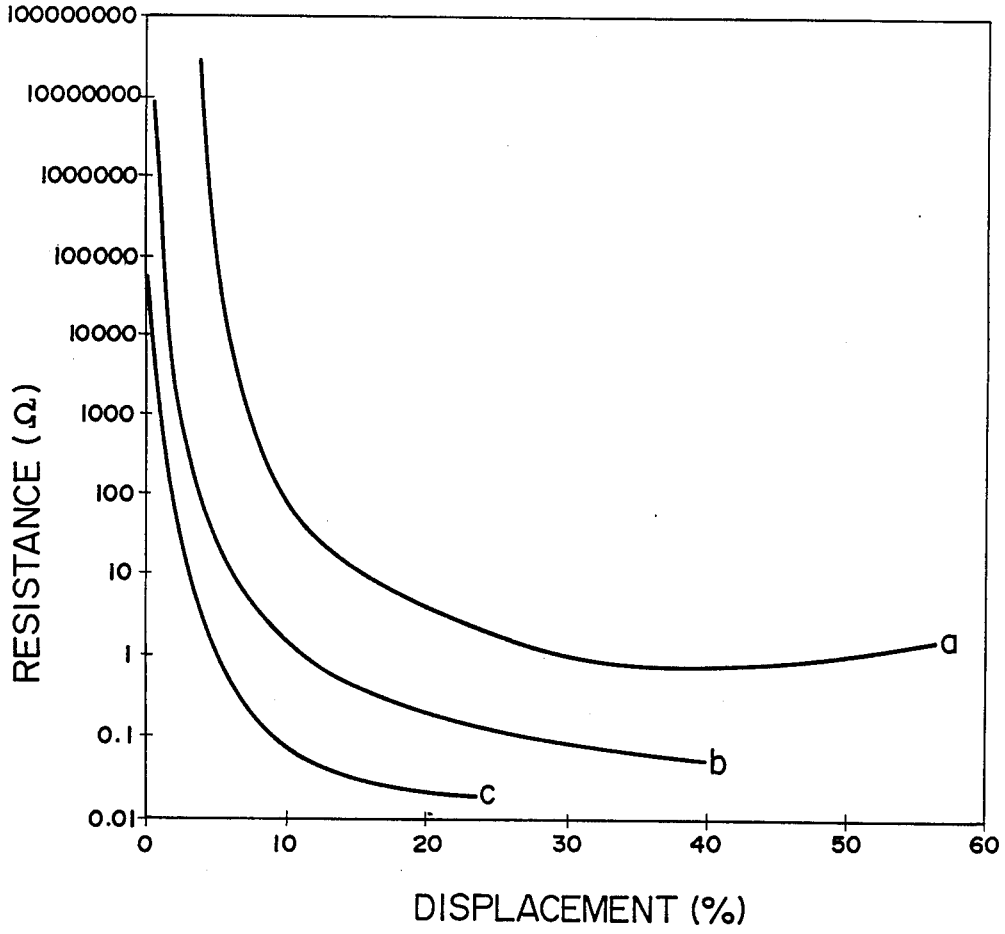
FIGS. 2A and 2B are respectively a graph showing the electric resistance characteristics of the variable resistor element.
Figure 2B:
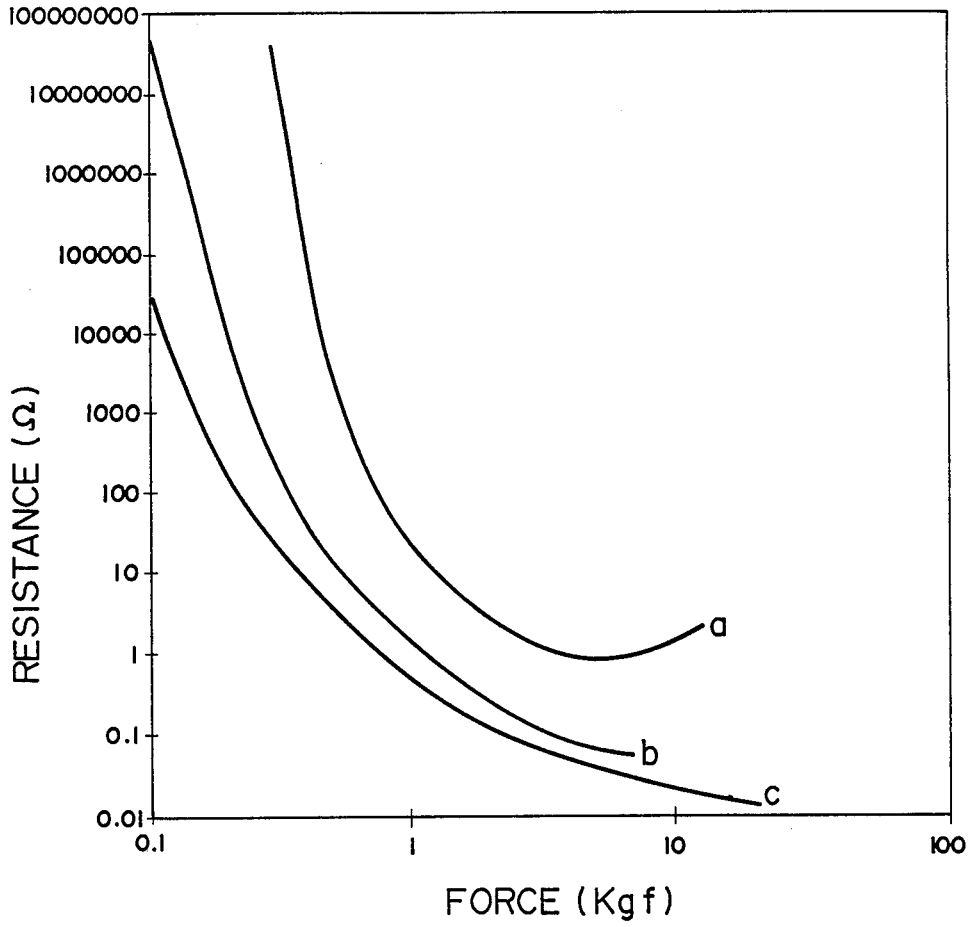

The variable resistor element of the present invention has resistance varying characteristics as shown in FIGS. 2A and 2B.

The variable resistor element of the present invention used in this measurement is made up by making the basic member 10 with the silicone gel with the penetration value of 150 and mixing the NCP-SI (product name), which is metal-covered particles manufactured by Nippon Kogaku Kabushiki Kaisha, in the basic member 10 as the conductive fine particles. It is molded in a cylindrical element with the diameter of 30 mm and thickness of 25 mm and provided with the electrodes at its both ends in the direction of thickness.

The method of measurement is such that said variable resistor element is deformed by applying a displacement pressure in the direction of thickness and the data related to the amount of displacement and the resistance value between electrodes is measured. Consequently, it is clarified that the value of internal resistance is vastly reduced even though the amount of displacement in the thickness of the basic member is approximately 10% as shown in FIG. 2A and it is also vastly reduced even though the pushing force applied to the basic member is within 1 kgf as shown in FIG. 2B.

In FIGS. 2A and 2B, a is a test sample of the silicone gel basic member containing 30 weight % of said NCP—SI (product name), b is a test sample of the silicone gel basic member containing 35 weight % of said NCP-SI and c is a test sample of the silicone gel basic member containing 40 weight % of said NCP-SI.

FIG. 2A shows the variations of internal resistance (Ω) in reference to the amount of displacement (%) of the silicone gel basic member and FIG. 2B shows the variations of internal resistance (Ω) in reference to the depressing force (kgf) applied to the silicone gel basic member.

Said NCP-SI (product name) has an average particle size of 40 μm, metallizing ratio of 40%, and density of 0.90 g/cm$^3$ , and the volume resistance measured by kneading in epoxy resin is 6.78 Ω-cm for the filling ratio capacity of 30% and 0.14 Ω-cm for the filling ratio capacity of 45.4%.

The following describes the shock damping effect of the variable resistor element in accordance with the present invention.

In this test, each test sample was made in the shape of 10 mm thick mat and the measurement was carried out by the iron ball drop impact method.

Four kinds of buffer material such as ENSOLITE (trademark) manufactured by Uniroyal Corporation in the United States, silicone gel with the penetration value of 150, TORAYPEF (30-fold foamed polyethylene; trademark) manufactured by Toray Kabushiki Kaisha and the silicone gel basic member of the variable resistor element in accordance with the present invention were used as the test samples.

The silicone gel basic member used in this test is made up by mixing 40 weight % of said NCP-SI which is the metallized fine particles in the silicone gel with the penetration value of 150 and provides the characteristics shown with line c in FIGS. 2A and 2B.

The iron ball drop impact method is such that an iron ball of 510 g in weight is dropped onto the test sample placed on the table made of iron from the height of 69 cm and, at the same time, the shock conducted to the table is measured. The impact speed of the iron ball in this case is 3.68 m/sec. and the momentum is 1.88 kg-m/sec.

The maximum impact magnitude was measured by the storage oscilloscope manufactured by Kikusui Densi Kogyo Kabushiki Kaisha in Japan.

The results of measurement are shown below as the impact force (G).

| | First test | Second test | Average |
|---|---|---|---|
| ENSOLITE | 17.60 | 17.95 | 17.78 |
| TORAYPEF | 19.03 | 20.11 | 19.57 |
| Silicone gel alone | 14.36 | 13.65 | 14.00 |
| Basic member of this resistor element | 12.93 | 12.93 | 12.93 |

From the above results, it was clarified that the buffering effect of the basic member of the present resistor element is best.

In addition, from this variable resistor element, the magnetic shielding effect can be expected by making the conductive fine particles 20 with a magnetic material, and these magnetic characteristics, that is, the magnetic shielding effect, the attracting effect and the magnetism detecting action can be selected as desired in accordance with the type of magnetic material and the quantity of fine particles.

Figure 3:
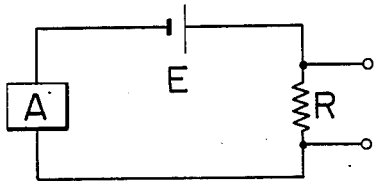
FIG. 3 is an electrical circuit diagram showing an example of an application of the variable resistor element in accordance with the present invention.

Since the variable resistor element in accordance with the present invention is as described above, it is used by, for example, detecting the current value between the both end electrodes 30 and 30' which varies in response to the deformation of the basic member 10 as shown in FIG. 3.

FIG. 3 shows the displacement gauge using the variable resistor element A in accordance with the present invention. The external force to be applied to the variable resistor element A varies the internal resistance value of the variable resistor element A and the variations of the output current caused by this variation of the internal resistance is detected by the detecting load R connected to the power supply E.

Said detecting load R can be for detecting the vibration. If the detecting load can be adapted so, the waveform and magnitude of the vibration produced in the variable resistor element A can be detected by the load R and therefore the variable resistor element A can be used as the vibration sensor.

Figure 4:
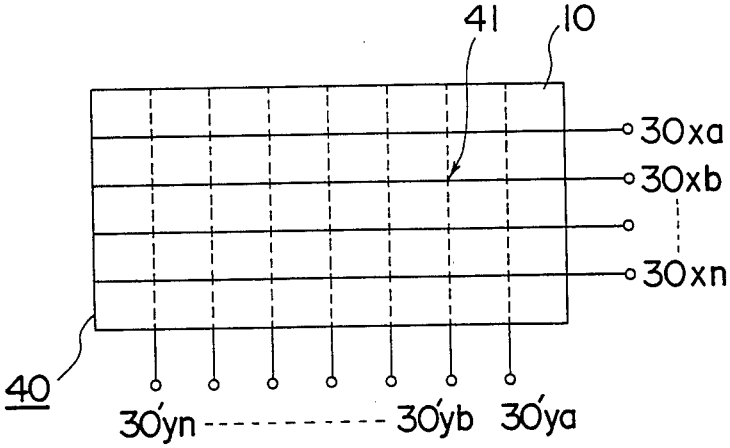
FIG. 4 is a plan view showing another embodiment of the variable resistor element in accordance with the present invention.

FIG. 4 shows the configuration where a number of electrodes 30 and 30' of the variable resistor element are provided in two directions of the basic member 10 which orthogonally intersect each other. For example, this variable resistor element can be used as the pressure sensor A.

In the embodiment, one electrode of said basic member 10 is formed as the X axis electrode group with a number of linear electrodes 30Xa, 30Xb, . . . 30Xn which are arranged in parallel while the other electrode of said basic member is formed as the Y axis electrode group with a number of linear electrodes 30'Ya, 30'Yb, . . . 30'Yn.

If a pressure is applied to one point, for example, point 41 in the figure in the pressure sensor, the internal resistance between the electrodes 30Xb and the 30'Yb reduces and the current increases whereby the degree of deformation and pressure at the pressure applied point 41 can be detected.

An example of application of the variable resistor element in accordance with the present invention is described below referring to FIGS. 5 to 16.

Figure 5:
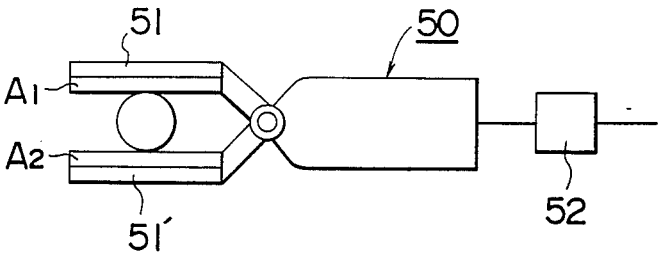
FIGS. 5 to 16 are respectively a rough illustration showing another example of application of the variable resistor element in accordance with the present invention.

FIG. 5 shows the clamper 50 employing this variable resistor element which will be used, for example, in each of the nail sections of a robot.

The insides of holding members 51 and 51' of this clamper 50 are made as the pressure applying parts and are made of the variable resistor elements A1 and A2 in accordance with the present invention.

The external surfaces of variable resistor elements A1 and A2 of these pressure applying parts are provided with a large frictional effect and the penetration value of the basic member 10 is selected in accordance with the object to be held. For example, the silicone gel material with a penetration value of 100 to 200 is used for holding eggs.

The holding pressure of the variable resistor elements A1 and A2 of the pressure applying parts is transmitted as an electrical signal to the control part 52 to control the holding force and operation of the clamper 50.

Since the variable resistor element of the present invention can detect an evenness of object through sensing of a surface deformation, it can be used as a sensor of a Braille point reader for the blind and a touch sensor for detecting a moving object. A safety device and a burglarproof apparatus can be made.

Figure 6:
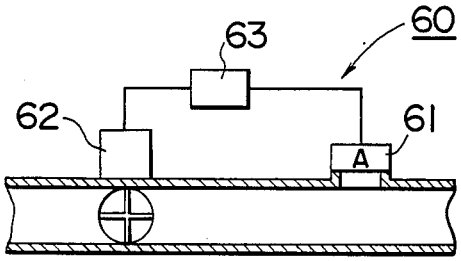

FIG. 6 shows the pressure detecting unit 60 provided with the detector 61 employing this variable resistor element A. This unit is designed to detect the pressure of a pressurized fluid and transmit a control signal to the control part 63 of the electromagnetic valve 62.

Figure 7:
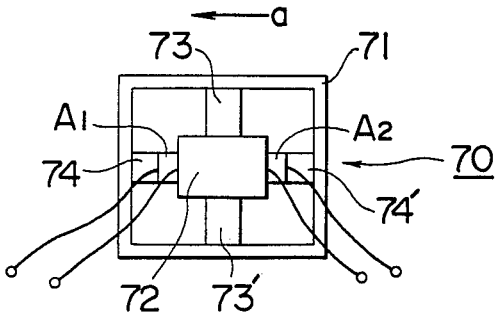

FIG. 7 shows an acceleration meter 70 using the variable resistor element A which incorporates the counter weight 72 which is suspended in midair at its upper and lower parts in the frame work 71 by supporters 73 and 73' which are made of a deformable material such as, for example, a gelled material. Said counter weight 72 is provided with the variable resistor elements A1 and A2 to bear the weight of the counter weight 72 in the acceleration direction a and hard supporters 74 and 74' are provided between the variable resistor elements A1 and A2 and the frame work 71. If the frame work 71 is accelerated, the counter weight 72 serves to depress one of variable resistor elements A1 and A2 against one of hard supporters 74 and 74' to deform it and therefore the acceleration speed to be applied to the basic member 71 is measured.

Figure 8:
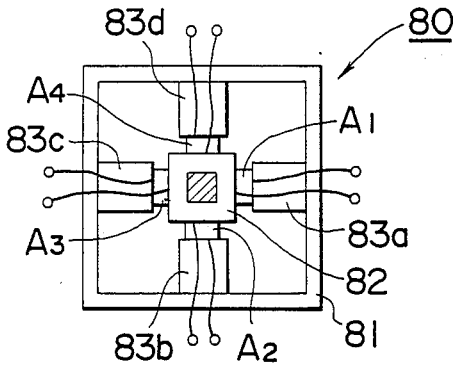

FIG. 8 shows a three-dimensional acceleration meter 80 using said variable resistor element A. Said meter 80 incorporates the counter weight 82 inside the frame work 81 and said weight 82 supported inside said frame work by supporters 83*a* to 83*d* made of, for example, a harder gelled material than the variable resistor element A or a harder spring member or the like than the variable resistor element so that said counter weight 82 can be freely moved and adapted so that a detection signal is generated by deforming at least one of the variable resistor elements A1 to A4, when at least one of variable resistor elements A1 to A4 provided betwee supporters 83*a* and 83*d* is depressed against one of supporters 83*a* to 83*d* by the acceleration of the counter weight 82.

Though said counter weight 82 which is formed as a square cube is a better shape to apply a pushing force to the variable resistor elements A1 to A4, it can also be spherical depending on the case. Such spherical form is advantageous in that the space for installing variable resistor elements A1 to A4 can be increased.

The electrodes of said variable resistor element A shown in FIGS. 7 and 8 are preferably made up to be hard by, for example, gold-plating the copper members, and said supporters 74, 74' and 83*a* to 83*d* can be made of an insulating material which can compress the variable resistor element A with its repulsive force.

Figure 9:
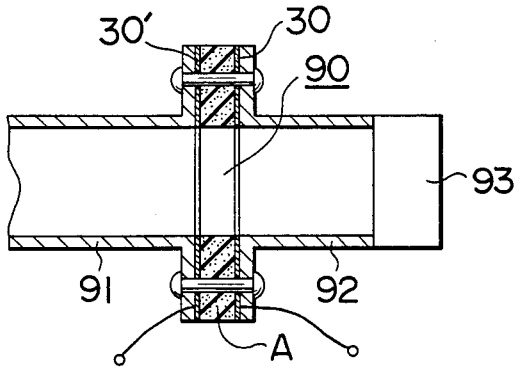

FIG. 9 shows a packing 90 using the variable resistor element A. Said packing 90 is made up by using the variable resistor element A in which magnetic conductive fine particles are mixed.

The conductive fine particles are made up by, for example, electro-chemically plating glass-based silica balloons with nickel in a non-electrolytical method and two tubes 91 and 92 are magnetically coupled while being magnetically shielded.

Since this packing 90 is sandwiched by tubes 91 and 92 and flatly deformed, it provides an improved conductivity and excels particularly in the shielding effect in such case that tubes 91 and 92 form the waveguide of the electromagnetic wave generator 93.

Figure 10:
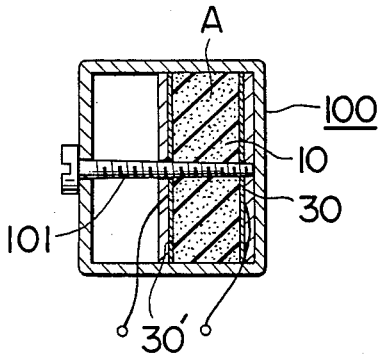

FIG. 10 shows a variable resistor device 100 using this variable resistor element A. This variable resistor device 100 is adapted to obtain variations of electrical resistance in the basic member 10 as the inter-terminal voltage by deforming the basic member 10 through displacement or recovery by moving hard terminal electrodes 30 and 30' with the actuating means such as screws 101 or the like in directions where these terminal electrodes are relatively moved to approach each other or moved away one from another.

Figure 11:
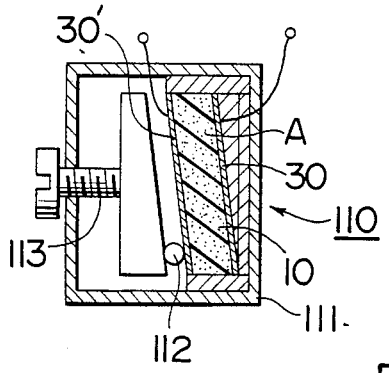

FIG. 11 shows a variable resistor device 110 using a variable resistor element A in accordance with the present invention. Said device 110, incorporates the variable resistor element A in a slanted position with a uniform thickness in the case 111 and is adapted to obtain an output voltage by pushing the surface of this variable resistor element A with a movable pushing member such as, for example, a rolling ball 112 which rolls on a track in a vertical plane. This rolling ball 112 is therefore designed to be moved by the rolling actuator 113 on the variable resistor element.

For this purpose, in this embodiment, the rotary member is fixed to the actuator 113 for rotating the rolling ball 112, which is rotatably secured on said rotary member in the vertical direction.

Figure 12:
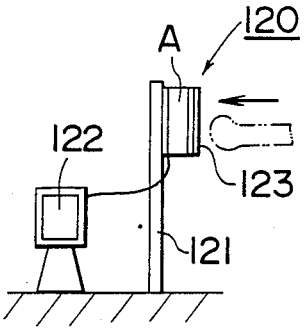

FIG. 12 shows the impact force measuring instrument 120 for sports application. This measuring instrument 120 is used to measure the punching impact of a boxing, Karate or similar athlete and is provided with the variable resistor element A fixed to the stay 121 and the display part 122 which receives the amount of deformation produced between electrodes of the variable resistor element as an electrical signal and display the amount of deformation after analysis. The variable resistor element A is provided with the protective external layer 123 at its impact receiving side.

In this measuring instrument 120, the variable resistor element A also acts as a buffer material to effectively protect the fingers of a measuring person.

Figure 13:
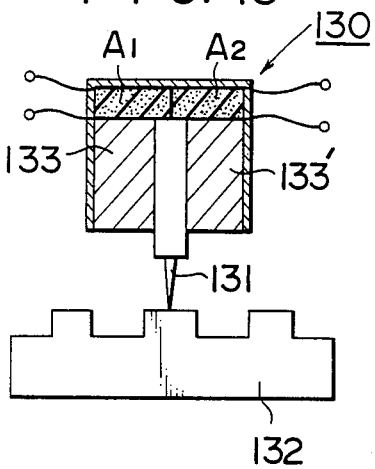

FIG. 13 shows vibration detector 130 using a variable resistor element A. Said vibration detector 130 is adapted to detect the vibration of the probe 131 by making the probe 131 contact the vibrating object 132 and two variable resistor elements A1 and A2 contact the top of this probe 131.

In the embodiment, two variable resistor elements A1 and A2 are used at the right and left sides. Thus, the right and left skew movement of the probe 131 can be detected and more accurate detecting operation can be carried out through arithmetic operation of output signals of a pair of variable resistor elements A1 and A2. In the figure, numerals 133 and 133' denote the flexible supporters. This detector 130 can be used, for example, in the pickup device for detecting the vibration signals from the grooves of a record disk.

Figure 14:
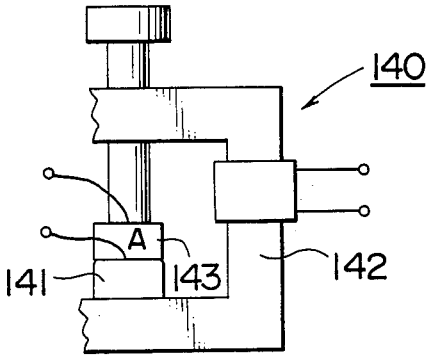

FIG. 14 shows a magnetic flux density gauge unit 140 using this variable resistor element A. In this unit, the conductive fine particles 20 of the variable resistor element A are made of a magnetic material and the variable resistor element A is attached to the extreme end of the measuring yoke 142 to make the variable resistor element A directly contact an object 141 to be measured, thus forming the contact part 143.

This gauge unit is advantageous in that, since the contact part 143 made of the variable resistor element A closely contacts the object 141 to be measured while being deformed and the contact accuracy is extremely high, the error of measurement due to a gap between the measured object 141 and the contact part 143 is minimized and also in that, since the deformation of the variable resistor element A can be taken up as an electrical signal, the hardness of the object 141 can be measured.

Figure 15:
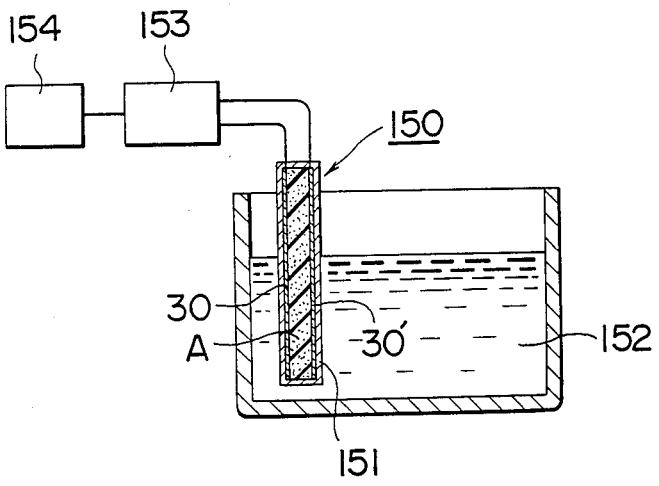

FIG. 15 shows a displacement gauge 150 using the variable resistor element A. Said displacement gauge 150 is made up by covering the variable resistor element A with a protective film 151 made of, for example, a teflon film coating material or fluororubber and used, for example, in liquid 152 while being uprightly secured.

In this case, the displacement gauge 150 is deformed by a liquid pressure to cause the resistance between electrodes 30 and 30′ to vary, thus becoming capable of detecting the liquid level by the measuring part 153 and displaying the data on the displaying part 154.

Figure 16:
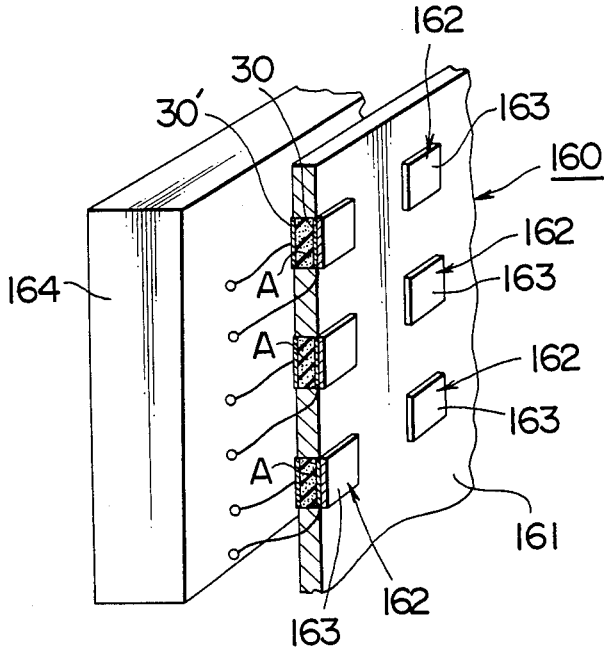

FIG. 16 shows the touch panel switch 160, which is made up by providing a number of switching parts 162 on the panel 161, each of said switching parts being constructed so that the finger touch surface 163 is provided at one of electrodes 30 and 30′ of the variable resistor element A whereby an input signal is supplied to the electric circuit 164 when the finger touch surface 163 is pressed.

Furthermore, the variable resistor element in accordance with the present invention can provide a stable temperature characteristic or a thermistor type temperature-dependent characteristic in response to the selected conductive fine particles which are mixed in the basic member of the variable resistor element.

The present invention is intended to provide the deformable type variable resistor element which employs the silicone gel whose repulsive elasticity is substantially negligible as the basic member and provides excellent deformability and buffering effect, and this variable resistor element can be used in various applications as described above. The present invention is not limited to said embodiment and various modifications are available within the range which does not deviate from the spirit of the present invention.

What is claimed is:

1. A deformable type variable resistor element using silicone gel consisting essentially of a basic member made of a silicone gel with a penetration value of approximately 50 to 200, electrically conductive fine particles in an amount of 20 to 50 weight % mixed in said basic member, and at least a pair of electrodes provided on said basic member through at least a part of the basic member, wherein said electrically conductive fine particles contact each other in said basic member due to deformation of said basic member to form electric paths, such that an electrical resistance between said pair of electrodes varies depending on the deformation of said basic member.

2. A deformable type variable resistor element in accordance with claim 1, wherein said electrically conductive fine particles are made of a magnetic material.

3. A deformable type variable resistor element in accordance with claim 1, wherein said electrically conductive fine particles have a specific gravity approximate to that of silicone gel which is a material for the basic member.

4. A deformable type variable resistor element in accordance with claim 1, wherein said electrically conductive fine particles are made up by coating glass-based silica balloons with an electrically conductive material.

5. A deformable type variable resistor element in accordance with claim 1, wherein the silicone gel of said basic member contains hollow fine particles.

6. A deformable type variable resistor element in accordance with claim 1, wherein the external surface of said basic member is covered with a non-tacking layer.

7. A deformable type variable resistor element in accordance with claim 1, wherein a flexible conductor with a large resistance value is passed through said basic member to connect the electrodes so that a bias current flows through this conductor.

8. A deformable type variable resistor element in accordance with claim 1, wherein said pair of electrodes are respectively provided on the external surfaces of the opposing sides of the basic member, each electrode being made a group of a plurality of parallel linear electrodes, said group of linear electrodes being made so that said linear electrodes are extended in a orthogonal direction to the other group of linear electrodes.

9. A deformable type variable resistor element in accordance with claim 1, wherein said electrodes are provided on the external surface of said basic member.

10. A deformable type variable resistor element in accordance with claim 1, wherein said electrodes are buried in said basic member.

11. A deformable type resistor element in accordance with claim 1 in which the electrically conductive fine particles are selected from the group consisting of electrically conductive materials of nickel, cobalt, gold, silver and carbon or particles coated with said electrically conductive materials.

12. A deformable type variable resistor element in accordance with claim 1 in which the electrically conductive fine particles are glass-based silica balloons coated with nickel.

13. A deformable type variable resistor element in accordance with claim 1 in which the electrically conductive fine particles are uniformly dispersed in the silicone gel member.

14. A deformable type variable resistor element in accordance with claim 11 in which the electrically conductive fine particles are uniformly dispersed in the silicone gel member.

15. A deformable type variable resistor element in accordance with claim 11 in which the electrically conductive fine particles have a particle range of 30 to 1OO μ.

16. A deformable type variable resistor element in accordance with claim 12 in which the electrically conductive fine particles have a particle size range of 30 to 100μ.

* * * * *

UNITED STATES PATENT AND TRADEMARK OFFICE

CERTIFICATE OF CORRECTION

PATENT NO. : 4,845,457

DATED : July 4, 1989

INVENTOR(S) : Motoyasu NAKANISHI

It is certified that error appears in the above-identified patent and that said Letters Patent is hereby corrected as shown below:

Col. 10, line 62 (Claim 15, line 3 of the claim), before "range of 30", insert -- size --.

Signed and Sealed this

Sixth Day of November, 1990

*Attest:*

HARRY F. MANBECK, JR.

*Attesting Officer*

*Commissioner of Patents and Trademarks*